US006935909B2

(12) United States Patent
Mann

(10) Patent No.: US 6,935,909 B2
(45) Date of Patent: Aug. 30, 2005

(54) APPARATUS AND METHOD FOR A GLIDING BOARD FOR FLUID RIDING SPORTS

(76) Inventor: Larry Wayne Mann, 1805 Groveton, Austin, TX (US) 78746

( * ) Notice: Subject to any disclaimer, the term of this patent is extended or adjusted under 35 U.S.C. 154(b) by 8 days.

(21) Appl. No.: 10/379,106

(22) Filed: Mar. 3, 2003

(65) Prior Publication Data

US 2004/0176000 A1 Sep. 9, 2004

(51) Int. Cl.[7] ..... B63B 35/81

(52) U.S. Cl. ..... 441/65; 441/68; 441/74; 441/79

(58) Field of Search ..... 441/79, 65–68, 441/74, 76, 129–132; 280/600–610, 18, 21.1, 23.1; D12/1, 6, 10, 11; D21/760–762, 766, 769, 770

(56) References Cited

U.S. PATENT DOCUMENTS

| | | | | | |
|---|---|---|---|---|---|
| 1,829,471 | A | * | 10/1931 | Brimhall | 441/65 |
| 2,389,729 | A | * | 11/1945 | Howland | 441/74 |
| D145,083 | S | * | 6/1946 | Howland | D21/769 |
| 2,414,480 | A | * | 1/1947 | Ferdinand | 114/244 |
| D168,999 | S | * | 3/1953 | Isaacs | D8/14 |
| 3,027,575 | A | * | 4/1962 | Fortin | 441/68 |
| 3,080,585 | A | * | 3/1963 | Marble | 441/68 |
| 3,099,025 | A | * | 7/1963 | Merkley et al. | 441/68 |
| 3,173,161 | A | * | 3/1965 | Amsbry | 441/68 |
| 3,276,050 | A | * | 10/1966 | Edwards | 441/74 |
| D206,506 | S | * | 12/1966 | Lambach | D21/769 |
| 3,289,227 | A | * | 12/1966 | Kelly | 441/74 |
| D207,612 | S | * | 5/1967 | Crabb | D12/11 |
| 3,372,945 | A | * | 3/1968 | Salisbury | 280/18 |
| 3,455,261 | A | * | 7/1969 | Perrin | 114/39.15 |
| 3,580,598 | A | * | 5/1971 | de Pauw | 280/18 |
| 3,774,254 | A | * | 11/1973 | Meyer | 441/68 |
| 4,250,585 | A | * | 2/1981 | Theriault et al. | 441/70 |
| 4,305,603 | A | | 12/1981 | Muller et al. | |
| D265,898 | S | * | 8/1982 | Cerkovnik et al. | D12/303 |
| 4,403,785 | A | * | 9/1983 | Hottel | 280/14.23 |
| 4,433,855 | A | * | 2/1984 | Wyke | 280/609 |
| 4,608,023 | A | * | 8/1986 | Williams | 441/68 |
| 4,629,435 | A | | 12/1986 | Pitcairn | |
| D290,151 | S | * | 6/1987 | Cashmere | D21/769 |
| D293,259 | S | * | 12/1987 | Connelly et al. | D21/766 |
| 4,767,369 | A | | 8/1988 | Snyder | |
| 4,795,386 | A | * | 1/1989 | LaPoint | 441/68 |
| D299,846 | S | * | 2/1989 | Shanelec | D21/769 |
| D299,847 | S | * | 2/1989 | Shanelec | D21/769 |
| 4,857,025 | A | * | 8/1989 | Brown et al. | 441/65 |

(Continued)

FOREIGN PATENT DOCUMENTS

| | | | | |
|---|---|---|---|---|
| EP | 59345 | A | * 9/1982 | B63B/1/04 |

OTHER PUBLICATIONS www.trickboardz.com.

www.inlandsurfer.com.

Wakeboarding—Feb. 2003, vol. 11, No. 1, pp. 36, 44, 61, 98–99, 116, 126 cont. next line World Publishers, Inc; Box 2456, Winter Park, FL 32790.

Alliance Wakeboard—Gear Guide 2003, pp. 18–19, 55, 86, cont. next line Alliance Multimedia, LLC, 2155 Newcastle Ave., Cardiff, CA 92007.

Level X—Issue 1, 2003, pp. 2–3, 17, 24, 29–33, 39, 70, 71, 78, 81, 115 cont. next line Level X, Box 336, Hood River, OR 97031.

*Primary Examiner*—S. Joseph Morano
*Assistant Examiner*—Ajay Vasudeva

(57) ABSTRACT

A curved lower surface of a gliding board, such as a wakeboard or a surfboard, is provided with an anticlastic shape to resemble the shape of a saddle. The lower surface of the board is concave in a transverse cross section and convex in a longitudinal cross section along the entire length of the board.

15 Claims, 3 Drawing Sheets

U.S. PATENT DOCUMENTS

D305,144 S * 12/1989 Shanelec ..... D21/769
D305,145 S * 12/1989 Shanelec ..... D21/769
D305,349 S * 1/1990 Shanelec ..... D21/769
4,894,035 A * 1/1990 Pia ..... 441/79
4,898,345 A 2/1990 Clayton
D317,343 S * 6/1991 Concannon ..... D21/769
5,127,862 A * 7/1992 Pia ..... 441/79
5,277,141 A * 1/1994 Csepregi ..... 114/43
5,340,144 A * 8/1994 Eleneke ..... 280/609
5,836,594 A * 11/1998 Simmons ..... 280/28
5,884,933 A * 3/1999 Trott ..... 280/603
6,007,393 A 12/1999 Choiniere et al.
6,203,389 B1 3/2001 Pearson
6,224,085 B1 * 5/2001 Cruz ..... 280/609
6,257,620 B1 * 7/2001 Kenney ..... 280/810
6,352,268 B1 * 3/2002 Peart ..... 280/14.21
D463,003 S * 9/2002 Alexander ..... D21/769
6,533,625 B1 * 3/2003 Taylor ..... 441/68
6,595,151 B2 * 7/2003 Keller ..... 114/39.14

* cited by examiner

APPARATUS AND METHOD FOR A GLIDING BOARD FOR FLUID RIDING SPORTS

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND OF THE INVENTION

1. Field of Invention

This invention relates to a sports device in which the rider glides over a fluid; specifically, this invention relates to a surfboard type device for riding on water, propelled by the force of a boat wake or a wave generated by a wave generating device.

2. Background of the Invention

Specially configured boards for gliding along a fluid are known, such as snowboards, snow skis, snow skates, snow sleds, water skis, wake boards, surfboards, skim boards, body boards, air boards, river boards, and the like. For purposes of this patent, "gliding board" will refer generally to any of the foregoing boards as well as to other board-type devices which allow a rider to traverse a fluid. For ease of understanding, and without limiting the scope of the invention, the inventive shape for the lower surface of a gliding board to which this patent is addressed is disclosed below, particularly in connection with a surfboard, designed to ride in the wake produced by a boat.

People have ridden surfboards on the ocean and behind boats for decades. The sport of wake surfing, riding a surfboard on the wake of a boat, has recently received new popularity. There are numerous reasons for this increase in popularity including:

a) the availability of sport boats that produce large wakes; and b) the injury rate of wake boarding, waterskiing and other higher speed water sports, and the desire of people to enjoy water sports with a lower injury rate; and, c) the development of smaller surfboards applicable to surf behind the boat.

There are several reasons why a smaller surfboard is beneficial in this context:

a) the person rides so close to the back of the boat that a longer surfboard strikes the boat, impeding the ride; and b) longer surfboards are less maneuverable; and c) longer surfboards are difficult to stow on the boat.

Traditional surfboards are generally made with a foam or balsa wood core covered with fiberglass and resin. This construction technique typically results in a surfboard that is:

a) fragile; and b) expensive to make; and c) too thick to fit in a standard wake board rack on the boat.

Many of the current wake surfboard designs have a tendency to unexpectedly nose dive into the water, thus upsetting the rider. Also, most traditional surfboards are unstable with side-to-side movements, and particularly for beginners, are like trying to stand on a log that wants to roll under you.

Flat skim boards with fins attached have also been utilized for wake surfing. A flat skim board does not provide the same control to the rider as does the current invention.

Water skis have been made with a longitudinal tunnel for decades. There has also been a recent patent for a snowboard that is tunnel shaped along the longitudinal axis. This prior art differs from the current invention in that the tunnel shape has occurred along a flat longitudinal axis with an upturned end or pair of ends, as opposed to possessing a saddle shape, or anticlastic shape, as does the current invention.

In an article in Wake Boarding (magazine), February 2003, p. 61, in the section sub-titled "Bottom Design", there is a reference to concaves on the bottom of wake boards. These concaves do not run the length of the board and would better be described as tunnels or channels, as the remainder of the bottom surface of the boards are flat along the transverse axis.

BACKGROUND OF THE INVENTION—OBJECTS AND ADVANTAGES

The present invention began with the design concept of a water sports board that operated at a lower speed than water skis or wake boards to reduce the inherent risk of injury associated with higher speeds. In the research for said water sports board, wake surfing was determined to meet the slower speed criteria.

In the current invention, the lower surface of the board is saddle shaped; and because of this shape of the lower surface of the gliding board, the central region of the board is less curved, or flatter, than the opposed edges. The result is a gliding board that has the acceleration qualities associated with a relatively flat surfboard and, the stability associated with a more curved surfboard; acceleration being necessary for a surfboard to be able to stay within the wave.

The edge of a surfboard is called a rail. The shape of the rail can have a substantial effect on the ride of the surfboard. With the curved shape of the lower surface of the current invention, the rails have more surface area in contact with the water than do boards with a flat or convex bottom; this results in the rail having greater interaction with the water.

If the contour of the base plane of the current invention is curved, wider in the middle and narrower at the front tip, there is an even greater effective longitudinal arc of the front, outer edges. An unexpected advantage of this greater effective arc is that if the front of the gliding board, or a side of the gliding board, should go deeper into the water, additional lift is created respectively at the front and side of the gliding board, tending to self correct nose down movements and side-to-side movements, thus resulting in a method for the gliding board to improve stability and avoid unexpected nose dive or barrel roll, as seen in other designs.

Another unexpected advantage of the current invention is that this gliding board can be made shorter and relatively wider than conventional surfboards, thus making this gliding board more maneuverable, more stable for beginners, and easier to stow on the boat or in a car.

Another advantage of the current invention is that if the outside dimensions are symmetrical, and if the arc of the longitudinal axis is symmetrical from end-to-end, and the arc of the transverse axis is symmetrical from side-to-side, the gliding board is thus equal at both ends; therefore, it is a twin tip surfboard that can travel with either end forward.

Said twin tip surfboard allows the rider to turn the gliding board 180 degrees and continue surfing "forward". This results in a method for a gliding board to surf forward in either direction. Asymmetrical shapes are also contemplated with such embodiments discussed in the detailed description of this invention below.

Because the edges of the current invention have greater interaction with the water, another advantage of the current invention is that fins that are smaller in size, than that used in a conventional surfboard, can be used. This makes this gliding board easier to stow on the boat and less likely to injure the rider if they should strike the lower surface of the gliding board, resulting in a method for making gliding boards safer.

Other embodiments of this invention include fins, ridges, tunnels, channels, depressions, and protuberances affixed into or onto the lower surface of the gliding board as a means of increasing the rider's control over the gliding board.

The shape, weight, strength and stiffness can be modified to adjust the riding characteristics of the gliding board. The following modifications are contemplated:

a) various construction materials, both isotropic and anisotropic;
b) the thickness of the overall construction;
c) the thickness of installed components;
d) the gliding board being of uniform thickness;
e) the gliding board being of variable thickness;
f) modifying the arc of the longitudinal axis;
g) modifying the arc of the transverse axis;
g) the application of different dimensions and shapes to the base plane contour of the gliding board.

The present invention does not possess the limitations inherent in traditional surfboards or flat skim boards utilized for wake surfing, is an inherently strong shape, is maneuverable, accelerates quickly, is stable for beginners, and is easy to stow on the boat, even fitting into conventional wake board racks.

Several embodiments of the current invention are being utilized in a product called Trick Boardz™. They can be viewed at the website www.trickboardz.com.

It is an object of the present invention to provide an improved gliding board for traversing fluids such as water, snow and air. Other objects of the present invention are, to provide a gliding board with the structural integrity to handle the anticipated mechanical loads placed upon the gliding board, to provide a gliding board that attains the ride characteristics sought by the sport's enthusiasts, to provide a safer sport and a safer gliding board, and to provide a gliding board that has exterior dimensions that facilitate stowing said gliding board upon or within a vehicle.

SUMMARY

The current invention is an apparatus and method for utilization as a gliding board, such as a wake surfboard. The design is of a lower surface of a gliding board that is saddle shaped, with the arc of the longitudinal axis being convex relative to the lower surface and the arc of the transverse axis being concave relative to the lower surface. The result is a gliding board exhibiting increased stability as well as increased performance. If the arcs are derived from curved line segments, the shape of the lower surface of the gliding board is anticlastic. Alternately, the arcs may include one or more straight line segments so that the shape of the lower surface of the gliding board is generally anticlastic.

DESCRIPTION—FIGURES

DRAWINGS—REFERENCE NUMERALS

Figure 1:
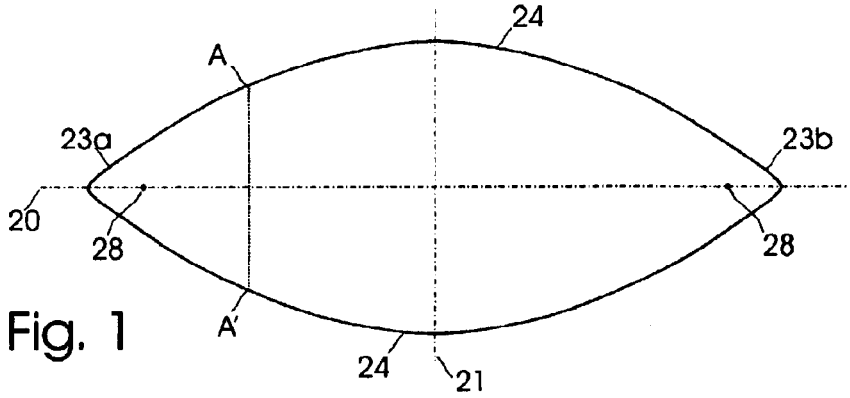
FIG. 1 is a schematic view of an embodiment of the invention.
Figure 2:
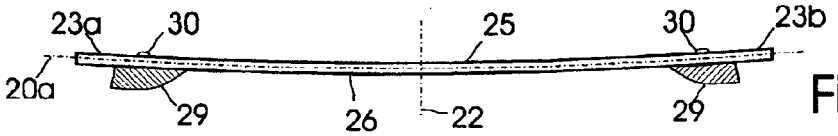
FIG. 2 is an end-to-end cross section taken along the longitudinal axis 20 in FIG. 1.
Figure 3:
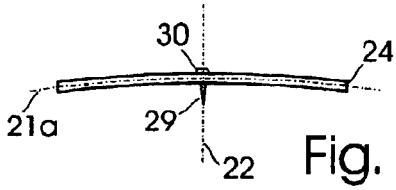
FIG. 3 is a side-to-side cross section taken along the transverse axis 21 in FIG. 1.
Figure 4:
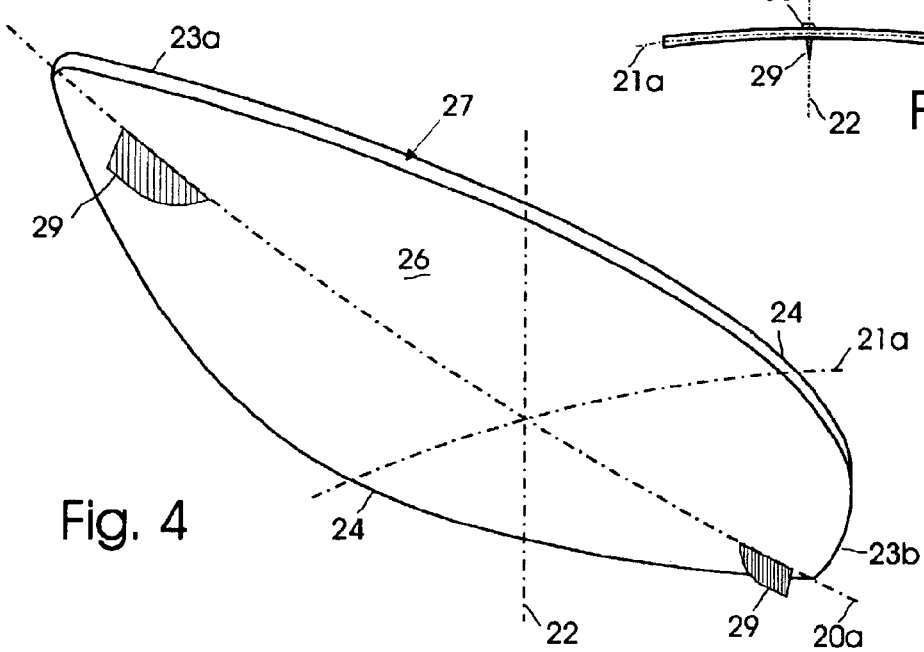
FIG. 4 is a perspective view of an embodiment of the present invention.
Figure 5:
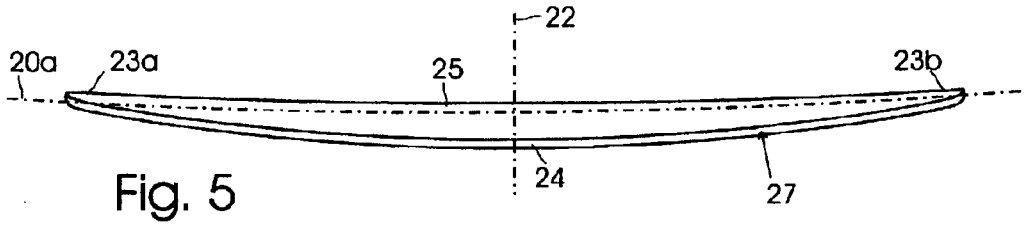
FIG. 5 is a side elevational view.

20 Longitudinal axis
20*a* Arc of the longitudinal axis
21 Transverse axis
21*a* Arc of the transverse axis
22 Normal axis
23*a* First end
23*b* Second end
24 Opposed edges
25 Upper surface
26 Lower surface
27 Outer perimeter edge
28 Openings for fasteners
29 Mounted fins
30 Mounting means for fins
31 Flat lands
32 Imbedded fins or runners
33 Imbedded channels or grooves
34 Imbedded depression
35 Imbedded ridge or protuberance

DETAILED DESCRIPTION OF EMBODIMENT—WAKE SURFING GLIDING BOARD

In one embodiment of the invention, shown in FIGS. 1–7, the gliding board has a pair of ends with the first end being 23*a* and the second end being 23*b*, a pair of opposed edges 24, and has an upper surface 25 and lower surface 26.

Figure 6:
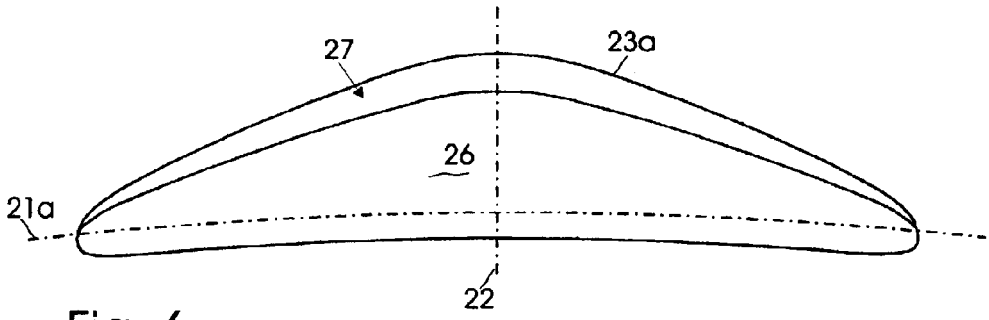
FIG. 6 is an end elevational view.
Figure 7:
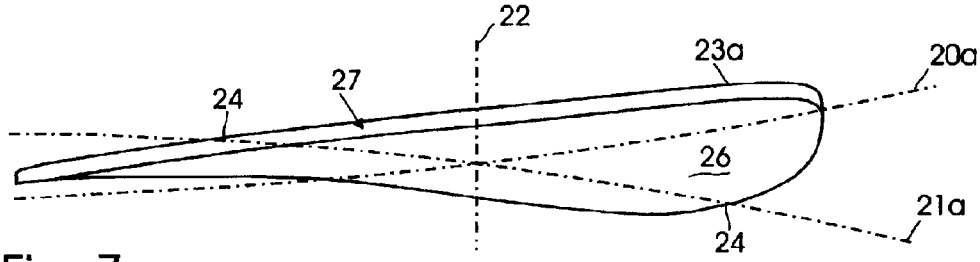
FIG. 7 is another perspective view of an embodiment of the present invention.
Figure 8:
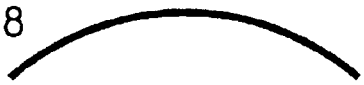
FIG. 8 is an arc with a constant radius.
Figure 9:
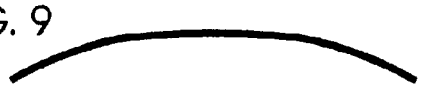
FIG. 9 is an arc with a non-constant radius.
Figure 10:
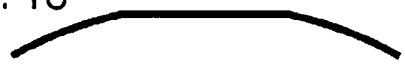
FIG. 10 is an arc composed of straight line segments and curved line segments.
Figure 11:
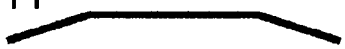
FIG. 11 is an arc composed of straight line segments.
Figure 12:
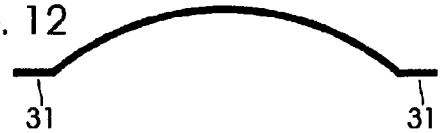
FIG. 12 is an arc with a constant radius with flat lands.
Figure 13:
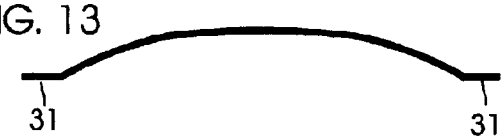
FIG. 13 is an arc with a non-constant radius, with flat lands.
Figure 14:
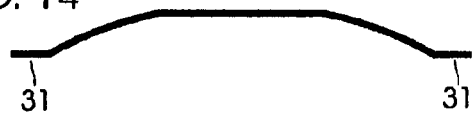
FIG. 14 is an arc composed of straight line segments and curved line segments, with flat lands.
Figure 15:
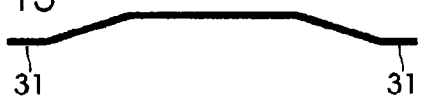
FIG. 15 is an arc composed of straight line segments, with flat lands.
Figure 16:
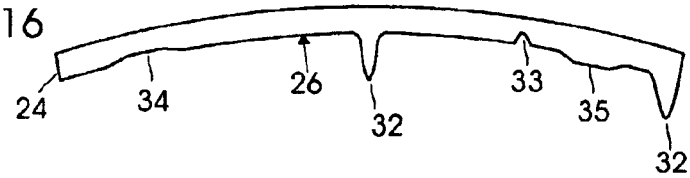
FIG. 16 is a side-to-side cross section of an embodiment that has imbedded fluid control devices taken along A to A' in FIG. 1.

FIG. 6 and FIG. 7 are shown with one end 23*a*. On these drawings, that end could also be labeled 23*b*.

The gliding board has a longitudinal axis 20 extending in an end-to-end direction, a transverse axis 21 extending in a side-to-side direction, and a normal axis 22 that is perpendicular to a base plane, extending through said longitudinal axis and said transverse axis. A perimeter of the gliding board in the base plane comprises an outer edge 27.

The gliding board is curved along an arc of the longitudinal axis 20*a*, with an equidistant radius of 530 inches, intersecting the midline of the transverse axis 21, convex towards the lower surface of the gliding board. In other embodiments, the arc of the longitudinal axis may have a non-equidistant radius or be composed of curved line segments and straight line segments FIGS. 8–11.

The gliding board is curved along an arc of the transverse axis 21*a*, with an equidistant radius of 103 inches, intersecting the midline of the longitudinal axis 20, concave towards the lower surface of the gliding board. In other embodiments the arc of the transverse axis may have a non-equidistant radius or be composed of curved line segments and straight line segments FIGS. 8–11.

In this embodiment shown, the gliding board is 51 inches in length along the longitudinal axis 20 and 22 inches in width along the transverse axis 21, the two ends 23*a* and 23*b*, are symmetrical, and the opposed side edges 24, are symmetrical, with the resultant being that the outer edge 27 is symmetrical; with either end, 23*a* or 23*b*, capable of being the nose or the tail of the gliding board. In other embodiments the ends, 23*a* and 23*b*, are not symmetrical, resulting in one end being the nose and the other end being the tail.

The gliding board can be made with isotropic or anisotropic materials. In this embodiment, the gliding board is made of seven vertically laminated veneers of wood, each 1/16 inch thick, for a resultant thickness of 7/16 inches. A center layer of veneer, with the grain of the wood running the length of the longitudinal axis 20, is attached to two layers of wood veneer, on each side of said center layer, with the grain of the wood running the length of the transverse axis 21; which are attached to two layers of wood veneer, on each side thereof, with the grain of the wood running the length of the longitudinal axis 20; which are attached to two layers of wood veneer, on each side thereof, with the grain of the wood running the length of the longitudinal axis 20 which comprise the upper surface 25 and lower surface 26. The veneers are joined by means of an adhesive and then cured while in a mold, with the lower surface conforming to the shape of this invention.

In this embodiment, the gliding board is a uniform thickness. Other embodiments that are not of a uniform thickness are contemplated. One such contemplated embodiment would have the ends and edges of the gliding board thinner than the central region where the rider stands.

In this embodiment, the gliding board is finished with an appropriate water proof material. Suitable waterproofing would be an acrylic base coat for color and a clear epoxy topcoat for waterproofing and durability. A non slip material is applied to the upper surface 25, thus enhancing the rider's ability to stand on the gliding board without slipping. There are numerous non slip materials that can be applied. Traditional surfboard wax provides good traction but is messy to have in a boat. There are several different types of peel-and-stick non-slip sheets commercially available. In the current embodiment, sheet rubber is attached with adhesive to the upper surface 25 of the gliding board in the area that the rider is likely to stand.

DETAILED DESCRIPTION OF EMBODIMENT—GLIDING BOARD WITH ATTACHED FINS

To improve the riders control over the gliding board, the previously described embodiment can be modified to include fins. Openings 28 are made in the gliding board initially described, to mount fins 29 to the lower surface 26 of the gliding board, utilizing a fastening means 30. In this embodiment, two fins 29 are mounted along the longitudinal axis 20, each 4 inches toward the midline from the end 23*a* and 23*b*. Other embodiments are contemplated that have other than two fins. Other embodiments are contemplated where the fins are placed at different locations on the board. It is also contemplated that the fins will be directed either parallel with the longitudinal axis or turned in or out relative to the longitudinal axis. The positioning of the fins may be fixed or adjustable. This results in an embodiment of this invention with improved rider control.

DETAILED DESCRIPTION OF EMBODIMENT—GLIDING BOARD DIMENSIONS FOR DIFFERENT SIZED RIDERS

To accommodate different sized riders, variations to the initially described embodiment are readily achieved by changing the outer perimeter 27 dimensions. The previously mentioned 51 inch length by 22 inch width accommodates a medium sized rider. For smaller riders, a 48 inch length by 20 inch width has been utilized and for bigger riders a 54 inch length by 24 inch width has been utilized. Even smaller sizes may be appropriate for children and even larger sizes for larger adults. Other sizes and contours of the outer perimeter 27 are contemplated and will be modified based upon the fluid upon which the board is gliding, the size of the rider, and the performance characteristics desired.

DETAILED DESCRIPTION OF EMBODIMENT—GLIDING BOARD MODIFICATION OF ARC OF THE TRANSVERSE AXIS

In another modification of the initially described embodiment, the arc of the transverse axis 21*a* is changed to an effective radius of 45 inches, thus increasing the depth of the concavity. This results in a gliding board that rides higher in the water and accelerates more quickly. It also is less forgiving for the beginner rider.

DETAILED DESCRIPTION OF EMBODIMENT—GLIDING BOARD MODIFICATION OF ARC OF THE LONGITUDINAL AXIS

In another modification of the initially described embodiment, the arc of the longitudinal axis 20*a* is changed to an effective radius of 266 inches, thus increasing the depth of the convexity. This results in a gliding board that rides lower in the water. It is more stable for the beginner and offers improved handling in rougher water conditions. This modification decreases the acceleration and is therefore less easy to surf.

DETAILED DESCRIPTION OF EMBODIMENT—GLIDING BOARD MODIFICATION OF ARC SHAPE

In another modification of the initially described embodiment, the arc of the longitudinal axis 20*a* or the arc of the transverse axis 21*a*, or both, can be modified. They can be formed from an arc with a constant radius FIG. 8, as previously described, or they can be formed from an arc with a non-constant radius FIG. 9, or they can be formed from a combination of curved line segments and straight line segments FIG. 10, or they can be formed from a combination of straight line segments FIG. 11.

Another way to measure the depth of the curve of the arc is to measure the arc at its maximum distance from the base plane. Using that measurement, it is anticipated that the maximum distance will be within the range of ⅛" and 6".

DETAILED DESCRIPTION OF EMBODIMENT—GLIDING BOARD WITH MODIFIED LOWER SURFACE

In another embodiment of the current invention, the transverse axis 21 is composed of an arc in the midline and flat lands at the perimeter, FIGS. 12–15. This shape may improve the ease of the rider turning the board along the base plane. Varying the width of the flat land relative to the width of the arc of the transverse axis 21*a* will impact the handling characteristics of the board

DETAILED DESCRIPTION OF EMBODIMENT—GLIDING BOARD WITH MODIFIED EDGES

To accommodate different skill levels of riders, variations to the initially described embodiment are readily achieved by changing the side edges 24. The side edges, also called rails, can be modified into numerous shapes and with varying angles relative to the base plane, thus affecting the gliding properties of the gliding board. Rounded edges have less grab into the water and are therefore more forgiving to a rider learning tricks. Sharp edges have more grab into the water and are therefore more appropriate to more advanced riders. The side edges can be sloped towards the upper surface, resulting in a sharper bottom edge that has more grab into the water. If the side edges are sloped towards the lower surface, the resulting bottom edge will be less sharp, but will have more surface area in contact with the water, resulting in a more forgiving board better suited for the beginner. Also contemplated are modifications of the edge from the group consisting of:

a. the edge perpendicular to the arc of the transverse axis 21*a*; and
b. the edge sloped towards the upper surface 25 of the board; and
c. the edge sloped towards the lower surface 26 of the board; and
d. the edge with rounded contours; and
e. the edge with sharp contours; and
f. the edge with channels; and
g. the edge with grooves.

DETAILED DESCRIPTION OF EMBODIMENT—GLIDING BOARD WITH FOOT BINDING MECHANISM

In another modification of the initially described embodiment, fasteners can be attached to the upper surface 25 of the gliding board to connect to a foot binding mechanism such as straps, or shoe type bindings in current use in other gliding board sports. This gives the rider an additional degree of control over the gliding board which allows the rider to lift the gliding board vertically. A foot binding mechanism minimizes the rider's ability to move around on the upper surface 25 of the gliding board thus limiting the rider's ability to control the gliding board by shifting weight. Foot bindings make an embodiment of this invention that is more useful in snow boarding, sail boarding, air surfing, and riding at a water ski cable park.

DETAILED DESCRIPTION OF EMBODIMENT—GLIDING BOARD WITH MODIFIED CONSTRUCTION TECHNIQUE

In another modification of the initially mentioned embodiment, the gliding board is made of nine vertically laminated veneers of wood, each approximately 0.05 inch thick, for a resultant thickness of approximately 7/16 inches. A center layer of veneer, with the grain of the wood running the length of the longitudinal axis 20, is attached to two layers of wood veneer, on each side of said center layer, with the grain of the wood running the length of the transverse axis 21; which are attached to two layers of wood veneer, on each side thereof, with the grain of the wood running at a forty five degree (45°) of the longitudinal axis 20; which are attached to two layers of wood veneer, on each side thereof, with the grain of the wood running at the opposite forty five degree (45°) of the longitudinal axis 20, thus forming an X shape in conjunction with the previous 2 layers; which are attached to two layers of wood veneer, on each side thereof, with the grain of the wood running the length of the longitudinal axis 20 which comprise the upper surface 25 and lower surface 26. This results in an embodiment of this invention that strengthens the gliding board to resist torsion along the longitudinal axis. In other embodiments, the thickness, quantity, orientation, and order in which the veneers are placed, can be adjusted to change the strength and flexibility of the current invention.

DETAILED DESCRIPTION OF EMBODIMENT—GLIDING BOARD WITH FORWARD PLACEMENT OF THE ARC OF THE TRANSVERSE AXIS

In another modification of the initially mentioned embodiment, the transverse axis 21 is moved 6 inches from the midline of the longitudinal axis 20, thus the arc of the longitudinal axis 20*a* is modified to an asymmetric arc that has less convexity towards the lower surface 26 of the gliding board at one end of the board, as compared to the convexity of the arc of the longitudinal axis at the other end. The result is an asymmetric board that has a front end 23*a*, the end that the transverse axis 21 was moved towards, and a tail end 23*b*; thus resulting in a unidirectional, single tip, gliding board. In this embodiment, if fins are utilized, the fins 29 may be placed only on the tail end 23*b*; either a single fin or a plurality of fins. Placing the transverse axis 21 at measurements other than 6 inches from the midline of the longitudinal axis 20 is also contemplated.

DETAILED DESCRIPTION OF EMBODIMENT—GLIDING BOARD WITH CONSTRUCTION USING COMPOSITE MATERIAL

In another embodiment of the current invention, the gliding board can be constructed as described in the several embodiments above, except that instead of using wood veneer for the construction, composite materials, such as fiberglass and resin, can be utilized as the construction material, such that the gliding board includes the lower surface 26 and other attributes described in this invention.

DETAILED DESCRIPTION OF EMBODIMENT—GLIDING BOARD WITH CONSTRUCTION USING MOLDING TECHNIQUES

In another embodiment of the current invention, the gliding board can be constructed using compression molding, roto-molding, vacuum molding, or other molding techniques, utilizing the range of materials that are available and appropriate for the respective molding technique, such that the gliding board includes the lower surface 26 and other attributes described in this invention.

DETAILED DESCRIPTION OF EMBODIMENT—GLIDING BOARD WITH IMBEDDED FLUID CONTROL DEVICES

In yet another embodiment, the lower surface 26 of the gliding board is modified to include imbedded fluid control devices so as to provide the rider with more control over the gliding board. The imbedded fluid control devices may include, but are not limited to, the group consisting of channels, ridges, fins, grooves, runners, depressions, and protuberances. The imbedded fluid control devices may be single, or a plurality, and may be oriented along the longitudinal axis 20, the outer perimeter contour 27, or other orientation, such that the gliding board includes the general shape of the lower surface 26 and other attributes described in this invention. This results in an embodiment of this invention with improved rider control.

DETAILED DESCRIPTION OF EMBODIMENT—GLIDING BOARD WITH IMBEDDED DEVICES AND ATTACHED FINS

In another modification of the previously described embodiment, openings 28 are made in the gliding board to mount fins 29 to the lower surface 26 of the gliding board, utilizing a fastening means 30 that work in conjunction with the imbedded fluid control devices previously discussed.

DETAILED DESCRIPTION OF EMBODIMENT—GLIDING BOARD WITH INCREASED VOLUME FOR OCEAN SURFING

Volume in a surfboard refers to the amount of cubic volume that a surfboard possesses. The greater the volume, the greater the amount of water displaced; thus, the greater amount of flotation provided by the surfboard. Volume is necessary for an ocean going surfboard as the rider uses the surfboard to float upon the water while awaiting a wave. Volume is also necessary to float the rider as they paddle the board to accelerate, to catch the wave. A gliding board ridden in the wake of a boat does not require volume since the rider can hold a tow rope to accelerate to the speed necessary to catch the wave.

In another embodiment, the current invention can be made utilizing traditional surfboard construction techniques with adequate volume to float the rider. The core can be made of a light weight material such as foam or balsa wood, and covered with a composite material such as fiberglass and resin, such that the gliding board includes the lower surface 26 and other attributes described in this invention. This results in an embodiment of this invention with the volume necessary for riding on an ocean wave.

DETAILED DESCRIPTION OF EMBODIMENT—GLIDING BOARD FOR GLIDING ON SNOW

In another modification of the previously described invention, the ends 23*a* and 23*b*, are wider than the opposed edges 24, such that the opposed edges curve inward, similar to the contour of a traditional snow board. This contour of the outer perimeter 27 thus allows the gliding board to turn while gliding on snow. This results in an embodiment of this invention with the contour necessary for riding on snow.

DETAILED DESCRIPTION OF EMBODIMENT—GLIDING BOARD FOR OTHER SPORTS BOARDS

In other modifications of the previously described invention, the dimensions, thicknesses, volumes, strength, attachments, materials, contours, and configurations can be modified so as to allow the current invention to be utilized as a wake board, a water ski, a skim board, a body board, a snow ski, a snow skate, a river board, and an air board.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the invention's claims and their equivalents.

What is claimed:

1. A gliding board, comprising:

an elongated element having a first end, a second end, and a pair of opposed edges, such that the first end, second end, and the pair of opposed edges form a perimeter that defines a contour of the gilding board in a base plane;

a longitudinal axis extending in an end-to-end direction, and an arc of the longitudinal axis;

a transverse axis extending in an edge-to-edge direction, perpendicular to said longitudinal axis, and an arc of the transverse axis; and an upper surface, such that a rider may be positioned on the upper surface;

a lower surface, such that the lower surface faces a fluid and the gliding board may glide over the fluid; wherein the lower surface defines a concave shape toward the lower side in a transverse cross section along the entire length of the board, and wherein an entire length of the lower surface is convex toward the lower side in a longitudinal cross section.

2. The gliding board recited in claim 1, wherein the arc of the longitudinal axis and the arc of the transverse axis are selected from the group consisting of:

a) an arc having a constant radii, and b) an arc having a non-constant radii, and c) an arc that consists of a combination of curved line segments and straight line segments, and d) an arc that consists of a combination of straight line segments.

3. The gliding board recited in claim 1, wherein the lower surface is anticlastic with the arc of the longitudinal axis and the arc of the transverse axis selected from the group consisting of:

a) an arc having a constant radii, and b) an arc having a non-constant radii.

4. The gliding board recited in claim 1, wherein the lower surface is generally anticlastic with the arc of the longitudinal axis and the arc of the transverse axis selected from the group consisting of:

a) an arc that consists of a combination of curved line segments and straight line segments, and b) an arc that consists of a combination of straight line segments.

5. The gliding board recited in claim 1, wherein the opposed edges are symmetrical, and the first end and second end are symmetrical, resulting in a twin tip surfboard symmetrical gliding board that may be ridden with either the first or the second end forward.

6. The gliding board recited in claim 1, wherein the arc of the transverse axis reaches from the first of the pair of opposed edges to the second of the pair of opposed edges.

7. The gliding board recited in claim 1, wherein the pair of opposed edges are bounded by a flat land that is parallel with the base plane, such that the arc of the transverse axis comprises the majority of the transverse cross section.

8. The gliding board recited in claim 1, wherein the arc of the longitudinal axis extends from the first end to the second end.

9. The gliding board recited in claim 1, wherein said gliding board is provided with a plurality of openings adapted to receive fasteners for securing attachments to the gliding board.

10. The gliding board recited in claim 1, wherein elements are incorporated into the lower surface, wherein said elements are selected from the group consisting of a channel, a groove, a fin, a runner, a ridge, a depression, and a protuberance.

11. The gliding board recited in claim 1, wherein the highest point of either the arc of the longitudinal axis or the arc of the transverse axis, above the base plane, is between ⅛ inch and 6 inches.

12. The gliding board recited in claim 1, wherein said gliding board is selected from the group consisting of a wake surfboard, a wake board, a water ski, an ocean surfboard, a skim board, a body board, a snowboard, a snow ski, a snow skate, a river board, and an air board.

13. The gliding board recited in claim 1, wherein the edge shape is selected from the group consisting of, an edge perpendicular to the arc of the transverse axis, an edge sloped towards the upper surface of the board, an edge sloped towards the lower surface of the board, an edge perpendicular to the normal axis, an edge with rounded contours, an edge with sharp contours, an edge with channels, and an edge with grooves.

14. The gliding board recited in claim 1, with the arc of the longitudinal axis in the vicinity of the first end of the gliding board having more curvature than the arc of the longitudinal axis in the vicinity of the second end such that a front end and a tail end of the gliding board is derived.

15. The gliding board recited in claim 1, with the arc of the transverse axis of the first end of the gliding board having less curvature than the arc of the transverse axis at the second end of the gliding board.

* * * * *